US007584613B1

(12) United States Patent
Crow

(10) Patent No.: US 7,584,613 B1
(45) Date of Patent: Sep. 8, 2009

(54) THERMAL ENGINE UTILIZING ISOTHERMAL PISTON TIMING FOR AUTOMATIC, SELF-REGULATING, SPEED CONTROL

(76) Inventor: Darby Crow, 863 Opal St., San Diego, CA (US) 92109

( * ) Notice: Subject to any disclaimer, the term of this patent is extended or adjusted under 35 U.S.C. 154(b) by 293 days.

(21) Appl. No.: 11/804,072

(22) Filed: May 17, 2007

Related U.S. Application Data

(60) Provisional application No. 60/801,029, filed on May 17, 2006.

(51) Int. Cl.
*F01B 29/10* (2006.01)

(52) U.S. Cl. ..... 60/519; 60/520; 60/525

(58) Field of Classification Search ..... 60/517, 60/518, 519, 520, 521, 525
See application file for complete search history.

(56) References Cited

U.S. PATENT DOCUMENTS 3,867,816 A * 2/1975 Barrett ..... 60/682
5,016,441 A * 5/1991 Pinto ..... 60/516
5,209,065 A * 5/1993 Sakata ..... 60/650
5,809,784 A * 9/1998 Kreuter ..... 60/650
5,894,729 A * 4/1999 Proeschel ..... 60/508
6,109,035 A * 8/2000 Guruprasad ..... 60/513
7,284,372 B2 * 10/2007 Crow ..... 60/519

* cited by examiner

*Primary Examiner*—Hoang M Nguyen
(74) *Attorney, Agent, or Firm*—Rod D. Baker

(57) ABSTRACT

A method and apparatus for converting thermal energy to mechanical energy. Operating on a thermodynamic cycle of isentropic compression, isothermal expansion, isentropic expansion and finally constant pressure cooling and contraction, an external heat engine utilizes a heat exchanger carrying heat from an external energy source to the working parts of the engine. Apparatus and methods are disclosed for engine piston timing, such that during isothermal expansion, each unit angular rotation of a drive shaft results in the capture of a constant, unit amount of working fluid expansion energy. Thus, the amount of energy captured during each unit angular rotation of apparatus drive shaft is a constant. Timing the working fluid expansion and fluid flow assures that the working fluid undergoes isothermal expansion, regardless of the quantum of heat energy applied. The modulation of heat input to the heat exchanger results in an automatic modulation of engine speed.

10 Claims, 9 Drawing Sheets

THERMAL ENGINE UTILIZING ISOTHERMAL PISTON TIMING FOR AUTOMATIC, SELF-REGULATING, SPEED CONTROL

CROSS-REFERENCE TO RELATED APPLICATIONS

This application claims the benefit of the filing of U.S. provisional application Ser. No. 60/801,029, filed on 17 May 2006, and the specification thereof is incorporated herein by reference. This application also is related to utility application Ser. No. 10/982,167, filed 4 Nov. 2004, now issued as U.S. Pat. No. 7,284,372, entitled "Method and Apparatus for Converting Thermal Energy to Mechanical Energy," the entire contents of which is incorporated by reference herein.

BACKGROUND OF THE INVENTION

1. Field of the Invention (Technical Field)

The present invention relates to engines, specifically to an engine utilizing an improved method for using external heat to heat a unit mass of working fluid and thereby convert the thermal energy to mechanical energy, where the unit mass is later expelled and a new unit mass of working fluid is introduced to repeat the cycle.

2. Background Art

Rudolf Diesel originally identified and developed a thermodynamic cycle similar to the cycle disclosed in the referenced co-pending United States patent application using internal isothermal combustion. However, the "Diesel cycle" is known today as constant pressure combustion, as difficulties in achieving internal isothermal combustion resulted in the general abandonment of the former concept. Seminal backround for Deisel's work is found in U.S. Pat. No. 542,846, issued 16 Jul. 1895. The engine and thermodynamic cycle presently disclosed herein are referred to as the "Crow Thermodynamic Cycle" and the "Crow Cycle Engine."

The present specification is related to the disclosure provided by this applicant in his co-pending U.S. patent application Ser. No. 10/982,167, published on 4 May 2006 as U.S. Patent App. Pub. No. 20060090467A1. The prior application is not deemed "prior art," but reference is made thereto as useful background information; the applicant has developed several significant improvements to that engine and methodology which are offered hereinafter.

SUMMARY OF THE INVENTION

Disclosure of the Invention

A method and apparatus for converting thermal energy to mechanical energy. Operating on a little utilized thermodynamic cycle of isentropic compression, isothermal expansion, isentropic expansion and finally constant pressure cooling and contraction, an external heat engine utilizes a heat exchanger carrying heat from an external energy source to the working parts of the engine. Pistons and cylinders are activated by appropriate means to adiabatically compress the working fluid, for example ambient air, to transfer the mass of the air through a heat exchanger to accomplish isothermal expansion followed by adiabatic expansion and, finally, exhaust the air to ambient to allow for constant pressure cooling and contraction. Energy is added to the working fluid and extracted from the engine during isothermal expansion, whereby the energy of compression is added by a flywheel or other appropriate energy storage means.

More specifically, means and methods are disclosed for timing the working fluid expansion and fluid flow to best assure that the working fluid undergoes isothermal expansion, regardless of the quantum of heat energy applied. The modulation of heat input to the heat exchanger results in an automatic modulation of engine speed. To accomplish the desired working fluid expansion, the piston timing is designed such that during isothermal expansion, each and every unit angular rotation of a drive shaft results in the capture of a constant, unit amount of working fluid expansion energy. Thus, the amount of energy captured during each unit angular rotation of apparatus drive shaft is a constant.

Several objects and advantages of the present invention are: (1) To provide a method and apparatus for implementing the Crow Thermodynamic Cycle to convert thermal energy to mechanical energy; (2) To provide a method for determining the timing of the expansion of the working fluid and flow through the heat exchanger; (3) To provide a method for using the expansion timing and fluid flows to determine the timing of the cooperating pistons; (4) To provide an engine that can utilize the Crow Thermodynamic Cycle and operate over a wide range of speeds and input temperatures; (5) To provide an engine that automatically adapts its speed to the applied input temperature and shaft load, while still operating on the ideal thermodynamic cycle; (6) To provide an engine design where the exact characteristics of the heat exchanger need not be known; (7) To provide an engine with improved specific power; (8) To provide an engine with greater flexibility in heat exchanger design; (9) To provide an engine design allowing the use of standard poppet-style valves; and (10) To provide an engine that is easy to assemble and disassemble and maintain.

There is in accordance with the present invention a method and apparatus for converting thermal energy to mechanical energy using the thermodynamic cycle disclosed in U.S. Pat. No. 7,284,372, while allowing for a wide range of operating parameters, automatic and self regulating speed adjustment, great design flexibility and ease of assembly and maintenance.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Like numerals and letters are used to label like elements and components depicted throughout the various views.

DESCRIPTION OF THE PREFERRED EMBODIMENTS

Best Modes for Carrying Out the Invention

The present disclosure is of an apparatus and method for converting thermal energy into mechanical energy. Reference is made to a thermodynamic cycle that will sometimes be called the "Crow Thermodynamic Cycle," the "Crow Cycle" or "the subject cycle." Also in the course of this disclosure reference will be made to a number of mathematical variables. For convenience, the several variables and their corresponding meanings are set forth in Table 1.

TABLE 1

| List of Variables | |
|---|---|
| $T_c$ | Low temperature reached by the working fluid during the thermodynamic cycle |
| $T_h$ | High temperature reached by the working fluid during the thermodynamic cycle |
| $T_{Rc}$ | Cold reservoir temperature |
| $T_{Rh}$ | Hot reservoir temperature |
| $T_B$ | Temperature at thermodynamic state B |
| $P_A$ | Pressure at thermodynamic state A |
| $P_D$ | Pressure at thermodynamic state D |
| $V_A$ | Engine volume at thermodynamic state A |
| $C_r$ | Isentropic compression ratio of the working fluid |
| $E_r$ | Expansion ratio: ending isothermal volume to beginning isothermal volume |
| $\Delta T$ | Temperature difference between the working fluid and the hot or cold reservoirs |
| h | Heat transfer coefficient used in basic heat transfer equation $Q = Ah\Delta T$ |
| $\mu$ | Thermal diffusivity of a gas |
| $Hx_v$ | Open volume inside heat exchanger |
| $\theta$ | Shaft rotation angle |
| $\theta_1$ | Isothermal expansion begin angle |
| $\theta_2$ | Isothermal expansion end angle |

TABLE 1-continued

| List of Variables | |
|---|---|
| E | Total energy extracted from gas |
| $\omega$ | Shaft rotational angle |
| P | Pressure |
| V | Volume |
| Re | Reynold's number |
| $\overline{R}$ | Universal gas constant |
| K | Unit energy taken during each unit rotation of drive shaft |
| $Q_{iso}$ | Isothermal heat input during one thermodynamic cycle |
| $U_m$ | Mean gas velocity through heat exchanger |
| L | Characteristic length of the heat exchanger |
| $\rho$ | Density |
| $V_1$ | Volume in first working chamber |
| $V_2$ | Volume in second working chamber |
| $V_i$ | Volume at beginning of isothermal expansion |
| V | Total engine volume |

Reference to the foregoing list of variables promotes a facile understanding of the further descriptions below.

Thermodynamic Cycle

Figure 1:
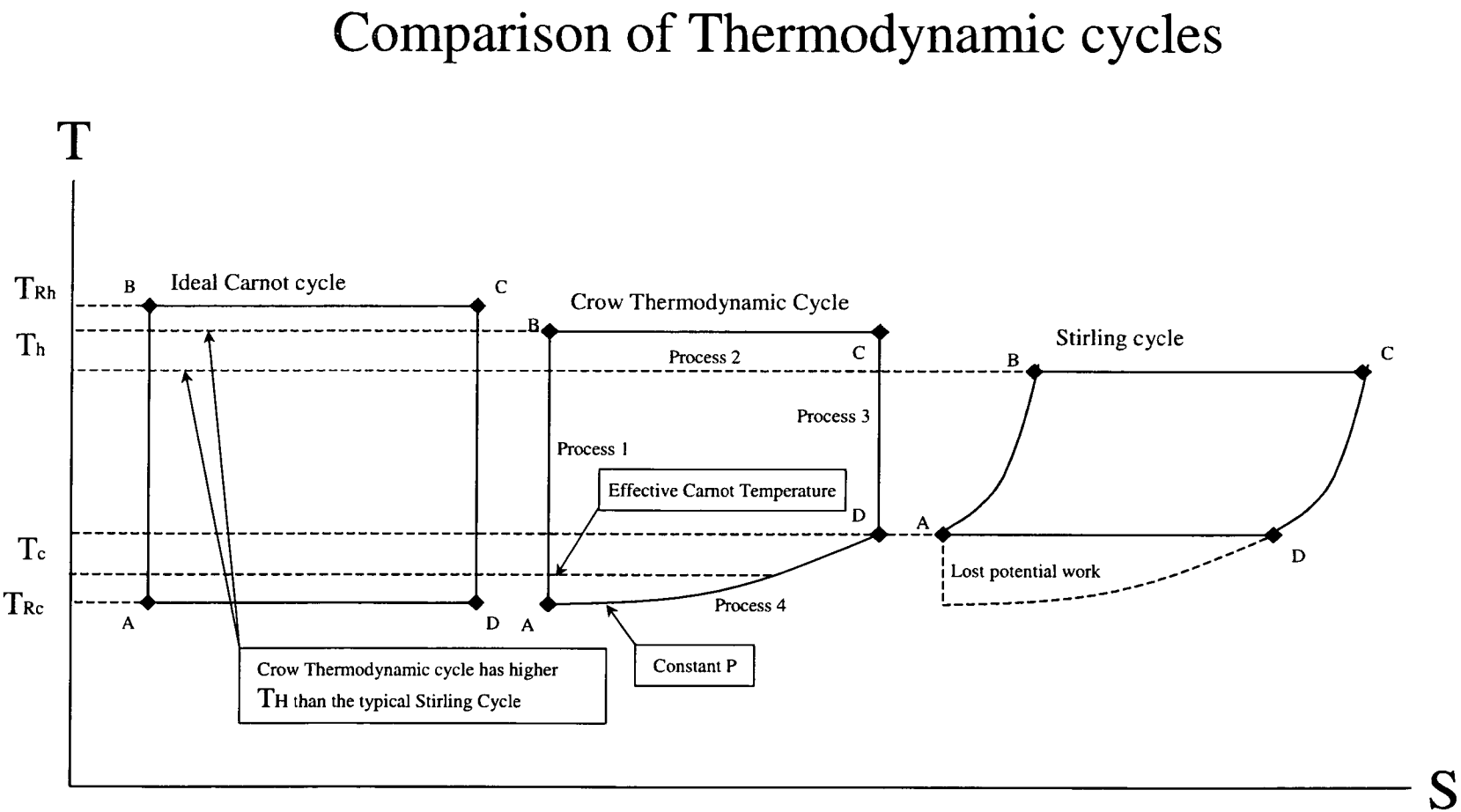
FIG. 1 is a graphical comparison, using T-S diagrams, of the ideal Carnot, the Crow, and the Stirling thermodynamic cycles.

A full explanation of the Crow Thermodynamic Cycle, and its exploitation to do work in an engine, is provided in my U.S. Pat. No. 7,284,372. In sum, to exploit the Crow Thermodynamic Cycle, the engine performs the following reciprocating steps, as shown in FIG. 1:

Intake of ambient air into the volume in state A of the cycle (part of process step 4);

Adiabatic compression of the air, governed by $C_r$, to achieve the desired air temperature (process step 1);

Isothermal expansion of the contained gas governed by $E_r$ (process step 2);

Adiabatic expansion of the air to ambient air pressure governed by $P_D=P_A$ (process step 3); and Exhaust of warm air at ambient pressure to the environment (part of process step 4—i.e., step 1 and step 5 are effectively concurrent process steps).

The cycle begins with a unit of working fluid at an ambient pressure and temperature A (FIG. 1). The working fluid preferably is air, but other working fluids, including liquids, may be suited to alternative embodiments of the invention. The working fluid is then isentropically compressed to a higher temperature and pressure point B. Then, the working fluid is isothermally expanded to point C. The working fluid is then isentropically expanded to point D, such that $P_D=P_A$. Between points A and D, the working fluid is expelled to the ambient environment at constant pressure, and new working fluid is drawn in from ambient at constant pressure.

Still referring to FIG. 1, during Process 1 work is done by the engine on the fluid to compress it and raise the temperature adiabatically to the high temperature $T_h$. Process 1 in the subject cycle is corollary to the regenerative heating process or stage in common Stirling engines. Process 1 is followed by the isothermal expansion Process 2, whereby heat energy is added to the working fluid while work energy is simultaneously removed. Process 2 is the process whereby all gross energy is added to the engine. All thermal energy added to the working fluid is balanced by the same amount of mechanical work extracted such that $\Delta h=0$.

During Process 3, the working fluid is expanded adiabatically, cooling it to $T_D$ as the pressure is reduced to ambient. It is important to recognize that by expanding to $P_A$, the resulting volume $V_D$ is greater than the volume $V_A$ in state A. This results in a piston stroke that is longer than that required to intake the volume $V_A$. During Process 3, work energy is recovered from the gas as it expands and cools. Process 3 effectively recaptures as much of the energy as possible that is supplied during Process 1. Process 3 of the subject cycle thus is corollary to the regenerative cooling process in conventional Stirling engines.

Notably, the rapid compression and expansion of the working fluid in Processes 1 and 3 have the major benefit of not being limited by the ability of a heat exchanger to transfer heat into or out of the fluid. Rather, the engine is limited only in the mechanical ability of the machinery. It should also be recognized that the energy not recovered in Process 3 represents the Carnot inefficiency inherent in every thermodynamic cycle.

Finally, Process 4, the constant pressure heat rejection process, is achieved by simply rejecting the working gas to the environment at constant pressure, as is done in Otto and Diesel cycle engines. The distinct advantage to this process is that the engine now requires no cold heat exchanger to remove the heat from the warm exhaust air. By dumping the exhaust to ambient at an elevated temperature, the engine is using the atmosphere as a heat exchanger with infinite capacity and eliminating the need for a cooler from the design. An advantage in this change is not only in the elimination of the machinery, but also in allowing for the design of an engine with whatever exhaust temperature is desired (above ambient temperature).

In the previously disclosed versions of processes and apparatuses for exploiting the Crow Thermodynamic Cycle, the flow of working fluid through the heat exchanger, and hence the piston timing, was required to be controlled quite exactly. Required fluid flow was calculated by estimating the convection heat transfer characteristics of the heat exchanger in use. With the known flow and a specified timing of a first piston, the second piston timing was specified. However, it has been found challenging to know with reasonable accuracy the heat transfer characteristics of a heat exchanger under ideal conditions. Under dynamic and changing conditions of an engine, it may be difficult to attempt to predict or model the instantaneous heat transfer to the working fluid.

The ideal expansion ratio and expansion piston timing is a given for a selected engine speed and heat exchanger temperature. A potential problem is that if the heat exchanger model is inaccurate, or if the heat exchanger temperature is inaccurate, then the piston timing likely may be sub-optimal or incorrect. Poor piston timing may result in the engine not operating isothermally as desired. The same is true for engine speed; if the engine is connected to a driven member whose speed must be allowed to fluctuate, then engine operation is likely to be degraded significantly as that speed diverges from the design speed. Thus, the above method of calculating the piston timing gives a solution that is likely to work only in a narrow or "tight" operating regime. If the engine is designed around a tight operating regime, the ramifications of excursions outside of that regime are likely to result in degraded performance.

Also the design of the piston timing in previously disclosed apparatus may have a disadvantage in that the expansion piston remains stationary during much of the operating cycle: intake, exhaust and compression. This adversely affects the specific power output (power output per unit mass), and is a relatively inefficient use of available components.

The following disclosure specifies further improvements developed to overcome the foregoing identified potential shortcomings, to provide an apparatus and method of increased efficiency. Further, the apparatus disclosed herein is easily assembled (and disassembled for repair or maintenance).

Automatic Isothermal Piston Timing

Figure 3:
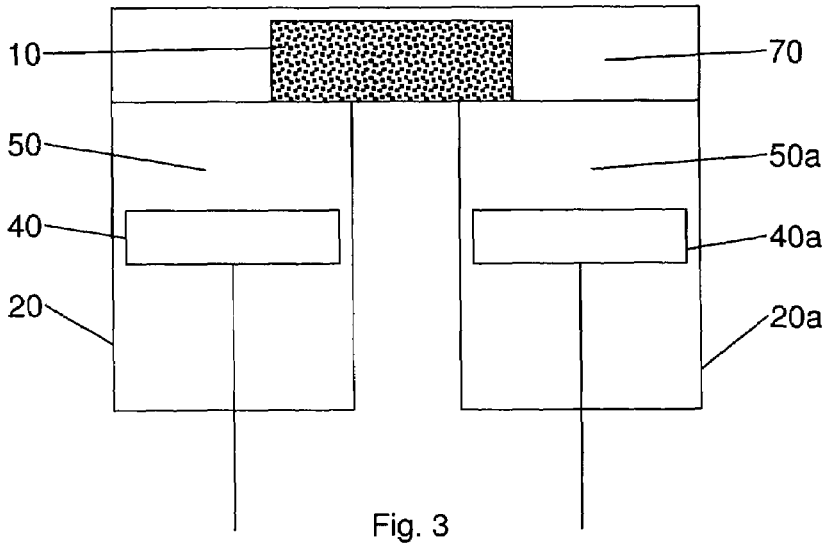
FIG. 3 is a simple diagrammatic view of an engine apparatus according to the present invention, showing pistons, cylinders, heat exchanger, and manifold.

Reference is made to FIG. 3, showing schematically certain fundamental components of an engine apparatus according to the present disclosure. The engine features a first working chamber 50 and a second working chamber 50*a*, with a porous heat exchanger 10 disposed operationally there-between. Fluid communication is allowed between the working chambers 50 and 50*a*, past the intermediate heat exchanger 10. The working chambers are defined by a first piston 40 and second piston 40*a* slidably disposed within first cylinder 20 and second cylinder 20*a*, respectively. First cylinder 20 and second cylinder 20*a* are in operable connection with an engine manifold 70 so as to create a gas-tight seal, thereby completing the definition of the working chambers 50 and 50*a*.

Correctly timing the working fluid expansion and fluid flow through the heat exchanger 10 is central to achieving the desired isothermal expansion required in the engine. The required fluid expansion and fluid flow determines the angular piston timing in the engine.

The goal of timing the working fluid expansion and fluid flow is to ensure that, under all situations (except perhaps steep transients), the working fluid undergoes isothermal expansion, regardless of the heat applied. The modulation of heat input to the heat exchanger 10 results in an automatic modulation of engine speed.

To accomplish the desired working fluid expansion, the piston timing is designed such that for each and every unit angular rotation of the drive shaft, a constant amount of working fluid expansion energy is realized or extracted. (The net energy out of the gas is positive). Mathematically, if θ is the shaft rotation angle, then $$dE(\theta)/d\theta=\text{Constant}$$

Further, the drive shaft's change in rotational energy can be expressed in terms of pressure and volume:

$$dE(\theta)/d\theta=P\cdot dV=\text{Constant}$$

Assuming shaft load on the engine is constant, ensuring $dE(\theta)/d\theta=P\cdot dV=\text{Constant}$ results in constant rotational speed of the engine.

Using the above equations in concert with the ideal gas equation $PV=\overline{R}T$, one can determine the required total engine volume V as a function of shaft angle θ to achieve the desired isothermal timing.

Knowing the engine volume V as a function of shaft angle, however, is only part of the requirements for isothermal timing. To maintain constant working fluid temperature (isothermal) while expansion energy is being extracted from the working fluid, the constancy of heat input to the working fluid must be assured. Since the heat transfer coefficient h is primarily a function of Reynolds number Re, uniform heat input is achieved by maintaining a constant Reynolds number Re through the heat exchanger 10 as a function of shaft rotation angle θ.

The volume and gas speed through the heat exchanger 10 are thus defined. Using the geometry of the engine to determine the corresponding working chamber volumes $V_1$ and $V_2$, and modest additional calculation known to one skilled in the art, determines the precise position of pistons 40 and 40*a* during isothermal expansion as a function of θ as desired.

By so defining the piston timing, engine speed may be regulated by the heat input to the heat exchanger 10 and the load applied to the shaft. Each unit angular turn of the shaft results in a unit of energy K of gas expansion. Because the Reynolds number Re is constrained to be constant, as a function of θ, the heat transfer coefficient h is increased or decreased by increasing or decreasing the shaft rotational speed ω. Thus if for a given load and heat exchanger temperature the needed or required gas expansion energy K is greater than the unit heat transfer energy, the engine slows down until the heat transfer into the gas is sufficient to balance with the gas expansion energy K. Alternatively, if the needed, or required gas expansion energy K is less than the unit heat transfer energy, the engine speeds up until the heat transfer into the gas is again balanced with K.

The present discussion of isothermal timing and how it is implemented in the current embodiment does not imply that this is the only acceptable means of implementing the method. Rather, the practitioner chooses the geometry or configuration of the engine, and the desired Reynolds number, and the disclosed method generates the appropriate working chamber volumes needed to achieve the desired Reynolds number.

The foregoing isothermal timing having been discussed conceptually, a brief mathematical description of the method is offered by way of additional disclosure.

Assume air as an ideal gas; $PV=\overline{R}T$

Further, as known in the art, expansion energy $E=\Sigma P\Delta V$, or $E=\int PdV$ Total specific energy per isothermal expansion process $Q_{iso}$ Unit energy per unit angular rotation of drive shaft K Energy taken from drive shaft during each unit angular rotation $dE=Kd\theta$ Energy from isothermal expansion equals heat input $dQ_{iso}=PdV$ Isothermal expansion $Q_{iso}=E$ $\int^2 Kd\theta=\int^2 PdV$; ideal gas $P=\overline{R}T/V$ $$\int_1^2 K\,d\theta=\overline{R}T\int_1^2 \frac{dV}{V}$$

Conventionally manipulating the above equation yields the result:

$$V=V_i e^{K/\overline{R}T(\theta-\theta_1)}$$

The equation above gives the engine volume V as a function of engine shaft angle θ. Angular power increment K is derived by dividing total energy E (known because the practitioner is free to and does choose $E_r$; it can be derived by anyone skilled in the art) by the isothermal angle $\theta_2-\theta_1$, with $\theta_1$ the isothermal begin angle and $\theta_2$ the isothermal end angle. $V_i$ is the engine volume at the start of isothermal expansion.

The foregoing provides a basis for determining generally the piston timing for an isothermal engine. But it provides for only the total volume enclosed in the engine, whereas for an engine according to the present disclosure, the volume in each working chamber 50 and 50*a* ($V_1$ and $V_2$), with respect to shaft angle θ, must be known.

To solve for specific piston timing, the Reynolds number of the heat exchanger is constrained. The Reynold's number $$Re,\ Re=\frac{\rho U_m L}{\mu},$$

is maintained constant through the heat exchanger 10 (where Re is a function of shaft angle, θ). Because Re is the primary variable determining heat transfer, holding Re constant also maintains constant heat transfer.

Since heat exchanger length L and the working gas's thermal diffusivity μ are constant, $\rho U_m$ is the value that must be held constant, with $U_m$ meaning mean flow velocity. To determine the piston timing, one must choose a value for Re. Solving for $$U_m=\frac{\mu Re}{\rho L},$$

it is observed that $U_m$ and ρ are functions of $V_1$ and $V_2$. Note also that $V=V_1+V_2+\text{Dead_Volume}$. Dead Volume is a constant, representing the un-swept volume in the engine, including the heat exchanger volume and any volume at the top of the chambers 50, 50*a* un-swept by pistons 40 or 40*a*. Thus, one can use the constraints $$U_m=\frac{\mu Re}{\rho L}$$

and $V=V_i e^{K/\overline{R}T(\theta-\theta_1)}$ mathematically to solve for either $V_1$ or $V_2$ as a function of θ. Thereafter, the other volume $V_1$ or $V_2$ is readily calculated from the formula $V=V_1+V_2+\text{Dead_Volume}$. Knowing the volume in the working chamber, then the position of the piston is also known. These previous determinations result in a defined function for $V_1(\theta)$ and $V_2(\theta)$.

Certain ramifications of the foregoing are recognized. The disclosure above assumes that the load is constant and therefore so is engine speed. Large speed variations occurring during the isothermal expansion phase will cause varying heat flux and heat input to the working fluid, resulting in deviations from the ideal isothermal process. It is expected that with substantial flywheels and multi-cylinder engines, engine speed fluctuation can be minimized to negligence.

Engine speed is caused to vary by increasing the heat exchanger temperature. An increase in heat exchanger temperature increases engine speed while a decrease in temperature decreases engine speed. Moreover, knowledge of the heat transfer characteristics of the heat exchanger 10 under specific operating temperatures is not required to design the piston timing, as the engine speed is self regulating.

The engine can be operated in a transient regime with the temperature of the heat exchanger 10 as the driving factor, with the transient response of the heat exchanger acting as the limiting factor to engine transient response. That is, the faster the heat exchanger increases or decreases temperature, the faster the engine can respond to transient power inputs. Additionally, engine speed and power output have a linear correlation with the temperature difference between the heat exchanger and the working fluid.

This method of isothermal timing can be applied to any engine design utilizing isothermal timing in general, and can be applied to any engine operating on the thermodynamic cycle disclosed in U.S. Pat. No. 7,284,372. Thus, this method can be used in an engine with any number of working chambers using a heat exchanger of any form or design.

An Embodiment of the Engine Apparatus

One preferred embodiment of the apparatus according to this disclosure features a heat exchanger between and above, but in immediate adjency with, parallel cylinders. One embodiment for exploiting the Crow Thermodynamic Cycle is illustrated generally in FIG. 4. Situated within a suitable frame are a first piston lever and roller assembly 100 and a second piston and lever assembly 100*a*. These assemblies 100, 100*a* are mounted in the frame by a piston lever axle 110 and a drive axle or shaft 160, the latter shaft mounting the piston motivating cams 170, 170*a*, 180, and 180*a*: (170 pushes the piston up, while 170*a* pulls the piston down during intake). The assemblies 100, 100*a* are operably connected to a valve cam axle 140 by means of a valve drive belt or chain 300. A flywheel 400 is mounted upon an end of the drive shaft 160. Upon the frame in operative connection with the valve cam axle 140 are first and second valve lever and roller assemblies, 120 and 120*a*, respectively. Valve lever axles 130, 130*a* coact with first and second valve cams 150, 150*a*, which regulate conditions in the engine manifold 70.

Figure 5:
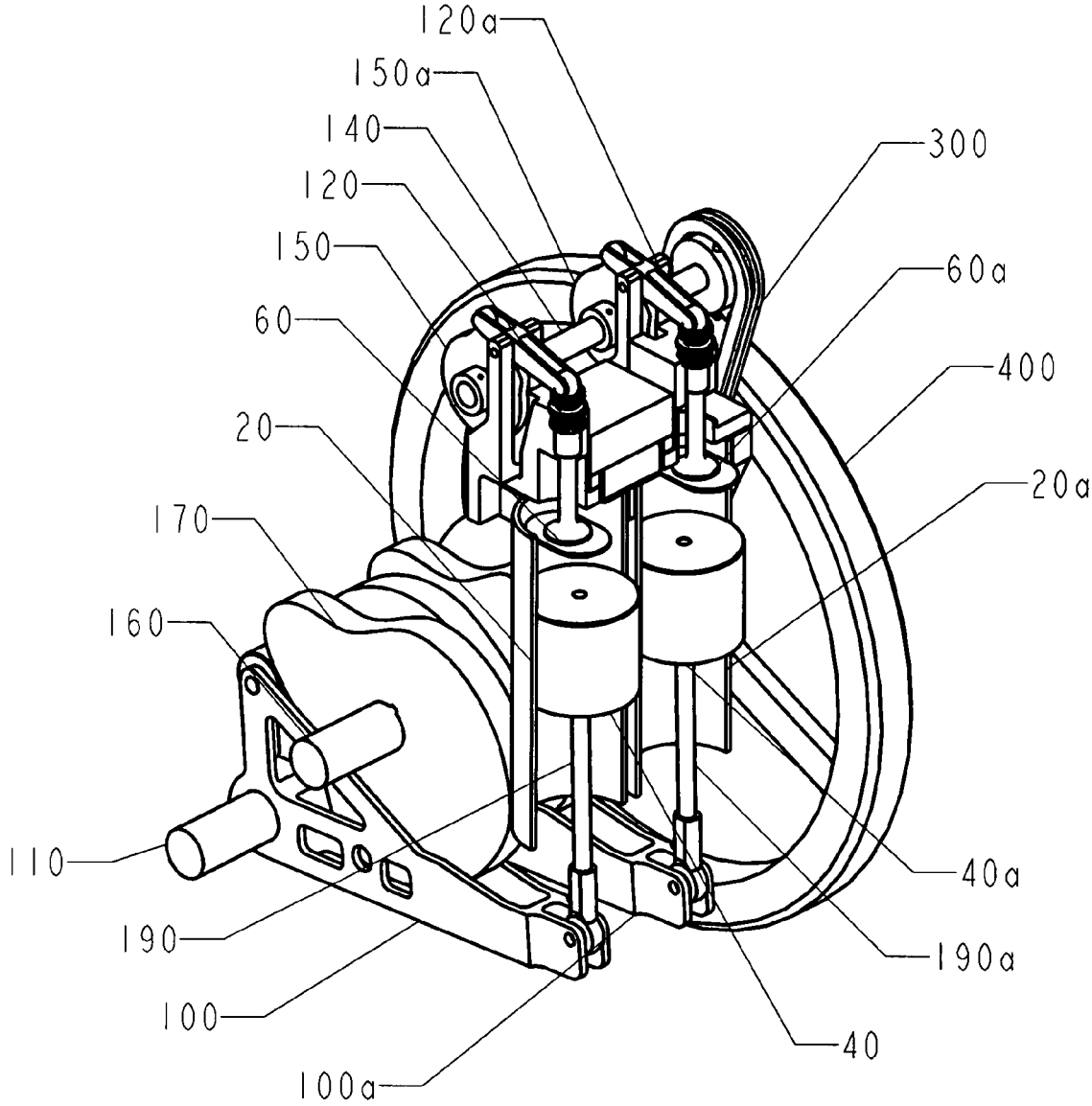
FIG. 5 is a perspective view showing the main components of the engine of the present invention in cross section, without frame structure.

Reference is made to FIG. 5, a perspective view showing the main components of the engine of the present invention in cross section with the frame structure removed. The engine consists of a first piston 40 and second piston 40*a*, each of which is identical to the other. These pistons fit slidably inside identical cylinders, first cylinder 20 and second cylinder 20*a*, respectively. First piston 40 and first cylinder 20, in combination with engine manifold 70, comprise a first working chamber 50. Second piston 40*a* and second cylinder 20*a*, in combination with engine manifold 70, comprise a second working chamber 50*a*. First cylinder 20 and second cylinder 20*a* are mechanically fixed to manifold 70 by any acceptable means to create a rigid connection and a gas tight seal between them preventing liquids or gasses passing between their interface. A flow-through energy-inputting heat exchanger 10 is disposed between the top of first cylinder 20 and second cylinder 20*a* by mechanical fastening in the center of manifold 70, which has fluid passageways for the purpose of allowing free communication between first working chamber 50 and second working chamber 50*a* through the flow-through heat exchanger 10.

Figure 6:
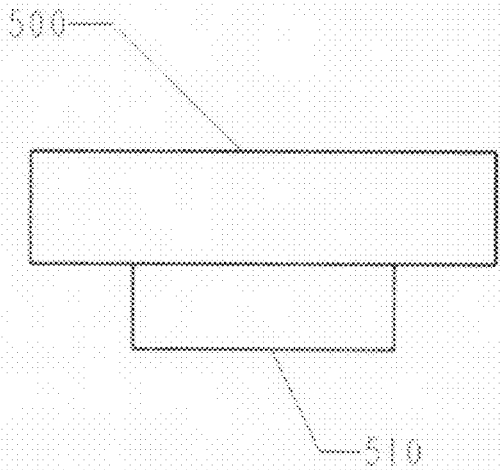
FIG. 6 is a perspective view showing the metal foam heat exchanger brazed to the mounting plate.
Figure 7:
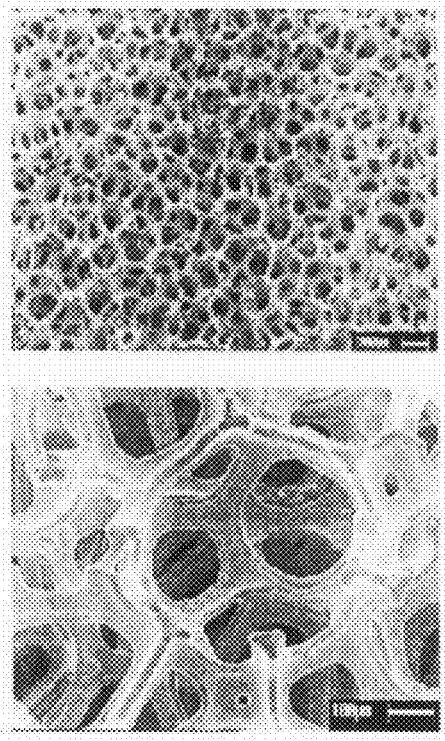
FIG. 7 is grey scale photomicrographs of a typical metal foam useable on a heat exchanger of the apparatus of the present disclosure.

As seen in FIG. 6, the heat exchanger 10 is comprised of metal foam brazed to a plate 500 that serves as the engine seal plate to seal the manifold where the opening for heat exchanger 10 is made. FIG. 7 shows a typical metal foam, commercially available for use in the heat exchanger assembly. The function of the heat exchanger 10 is as follows: Heat is applied to the outside plate 500, is conducted through the plate to the foam 510, conducts through the foam 510, and then is transferred to the working fluid via forced convection induced by the moving fluid.

Metal foam offers several significant advantages. First, the material offers very high specific surface area (surface area divided by unit volume). Second, relatively high heat transfer coefficients can be achieved with low pressure drop through the foam. A disadvantage to the foam is the low conductivity of the bulk foam material, which can be somewhat alleviated by the inclusion of fins or rods protruding into the foam to act as bulk conductors of heat.

Figure 8:
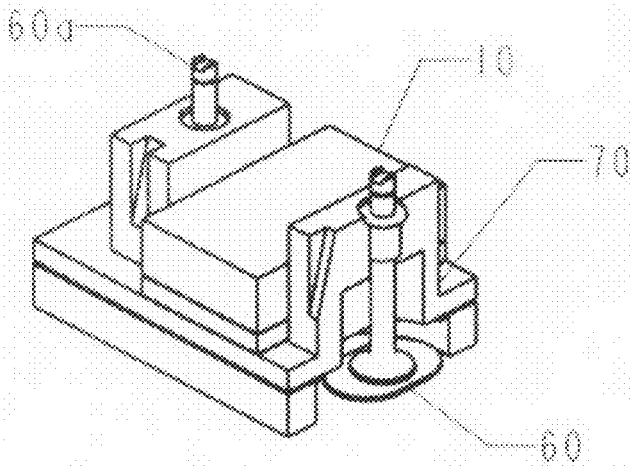
FIG. 8 is a perspective partially cut-away view showing the valve ports and manifold useable on an engine apparatus according to the present disclosure.

Reference is made to FIG. 8, a perspective cut-away view showing the valves and manifold. Manifold 70 incorporates means for slidably mounting first poppet valve 60 and second poppet valve 60*a*, in addition to sealing surfaces for said valves to seal against. Poppet valves 60 and 60*a* are used to control the net flow of working gas into and out of the engine. Said poppet valves are used for both intake of fresh working gas as well as exhaust of used working gas at the end of each cycle. In this embodiment, the poppet valves are oval in shape. There is nothing to preclude any other shapes, such as round, square, triangular, as may be or become available in the art.

Returning reference to FIG. 5, poppet valves 60 and 60*a* are actuated by first valve lever and roller assembly 120 and second valve lever and roller assembly 120*a*, respectively. Mounted on first valve lever axle 130 and second valve lever axle 130*a*, lever and roller assemblies 120 and 120*a* are in turn motivated by first valve cam 150 and second valve cam 150*a*, respectively. The cams 150, 150*a* are in the preferred embodiment substantially identically configured. Valve cams 150 and 150*a* are mounted rigidly to valve cam axle 140, which is forced to turn in tandem with drive axle 160 through the action of valve drive chain 300. Flywheel 400 is mounted rigidly to drive axle 160.

Figure 4:
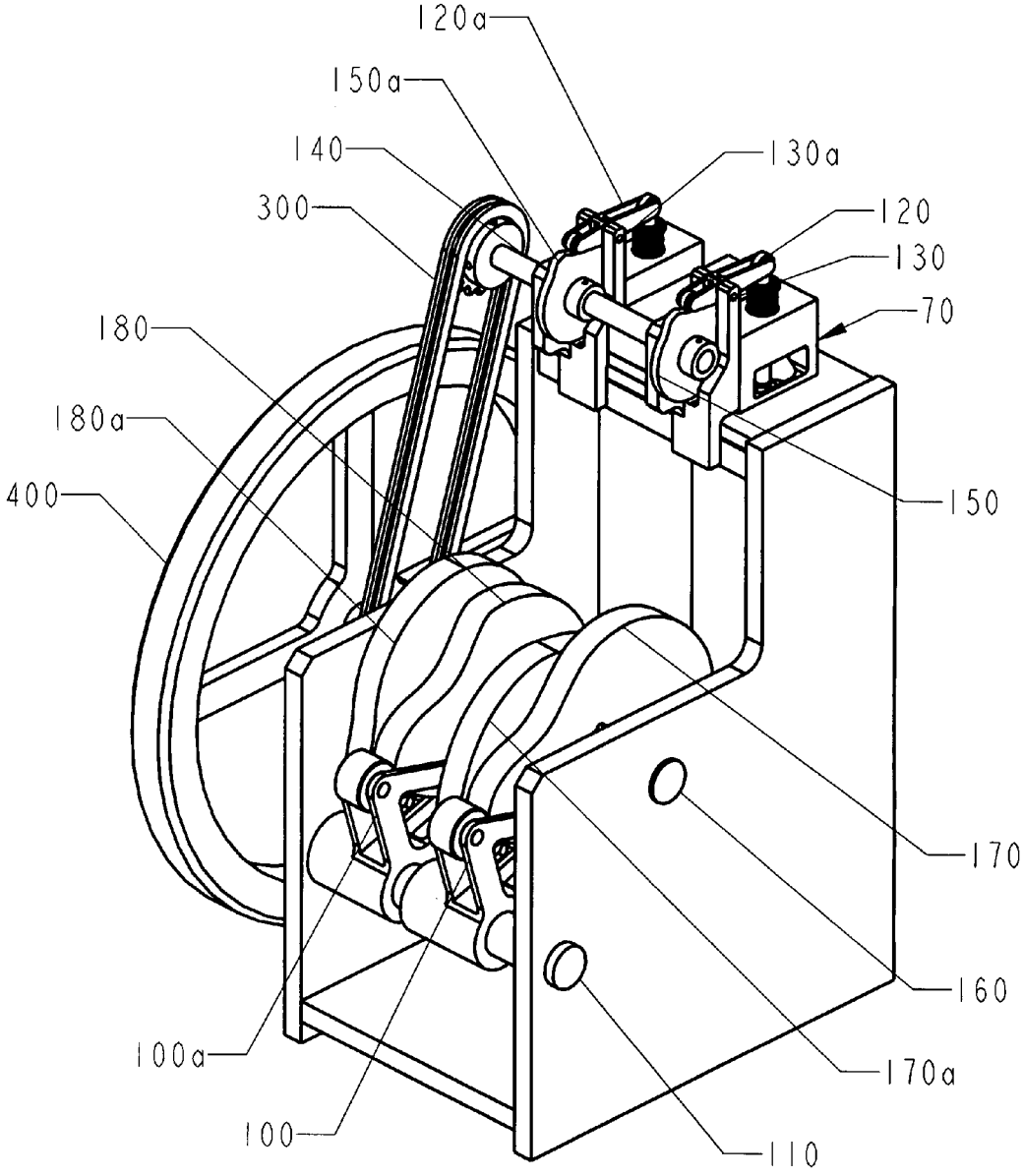
FIG. 4 is a perspective view of one embodiment of an engine apparatus according to the present invention.

Referring jointly to FIGS. 4 and 5, first piston push cam 170, first piston pull cam 170*a*, second piston push cam 180 and second piston pull cam 180*a* are fixed to drive axle 160. As drive axle 160 rotates, first piston push cam 170 and first piston pull cam 170*a* induce movement of first piston lever and roller assembly 100, while second piston push cam 180 and second piston pull cam 180*a* induce movement of second piston lever and roller assembly 100*a*. First piston rod 190 is connected to first piston lever and roller assembly 100 and first piston 40, such that movement of first piston lever and roller assembly 100 results in sliding movement of first piston 40 within first cylinder 20. Second piston rod 190*a* is connected to second piston lever and roller assembly 100*a* and second piston 40*a*, such that movement of second piston lever and roller assembly 100*a* results in sliding movement of second piston 40*a* within second cylinder 20*a*.

Because cams 170, 170*a*, 180 and 180*a* are fixed to rotate with drive axle 160, the proper design of cams 170, 170*a*, 180 and 180*a* results in the exact, coordinated timing of the movement of both pistons 40 and 40*a* required to cause isothermal expansion.

Engine Sequence and Timing

Figure 2:
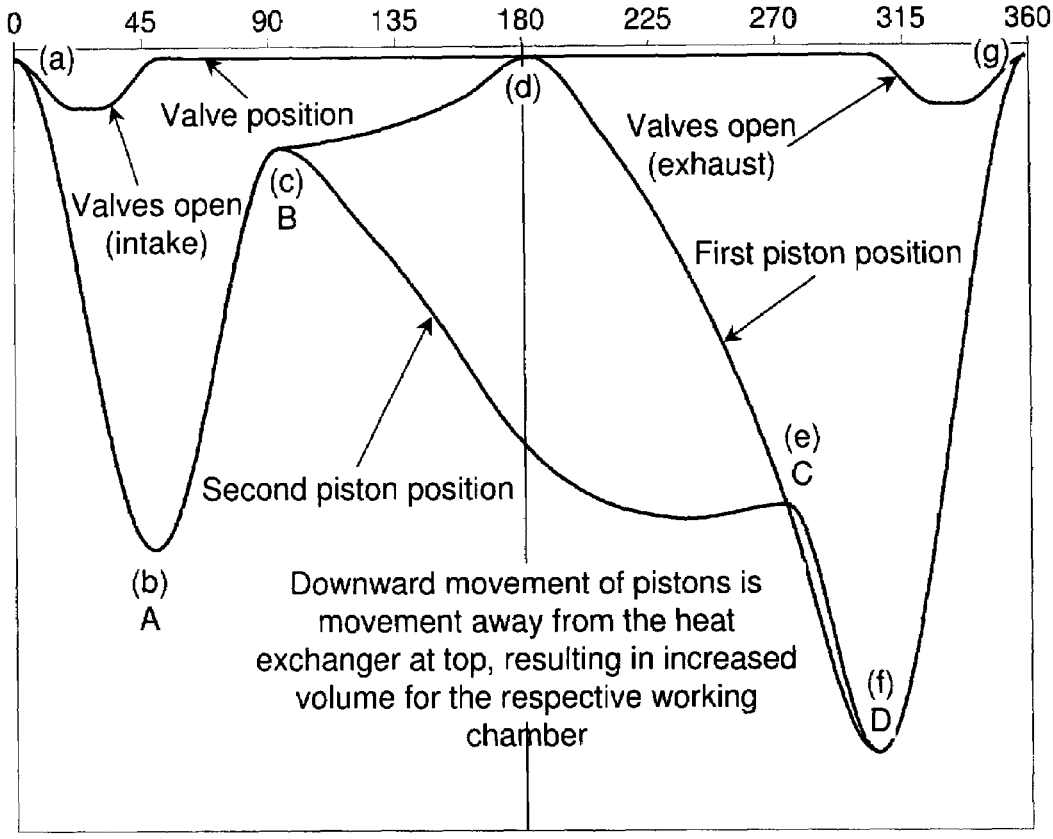
FIG. 2 is a graphical timing diagram of an embodiment of the engine apparatus according to the present invention.

The engine timing diagram in FIG. 2 illustrates the timing and movement of the pistons and valves as one engine cycle is completed. The diagram depicts the five steps required to complete the thermodynamic cycle: intake, isentropic compression, isothermal expansion, isentropic expansion, exhaust. Referring to FIG. 1 and FIG. 2, it is seen that the thermodynamic phases or states of the thermodynamic cycle "map" to the apparatus timing diagram points accordingly (thermodynamic states are capitalized, cycle map angles lower case parenthesized): A→(b), B→(c), C→(e), D→(f).

The timing diagram, FIG. 2, shows the timing of the pistons in this embodiment, using a particular Reynolds number. One can chose any Reynolds number to arrive at completely different piston timing during the isothermal expansion. For example, in FIG. 2, there is only the volume equivalent of one transfer of working fluid across the heat exchanger 10. One can adjust the Reynolds number such that there are two, three, or any number of desired working fluid transfers across the heat exchanger.

To make the engine operate, the temperature in the heat exchanger 10 is increased until the engine is able to idle under the power of the applied heat. Referring to FIG. 4, the engine is started by a rapid turning of the drive axle 160 imparting the flywheel 400 with enough energy to complete at least one full engine cycle.

Figure 9:
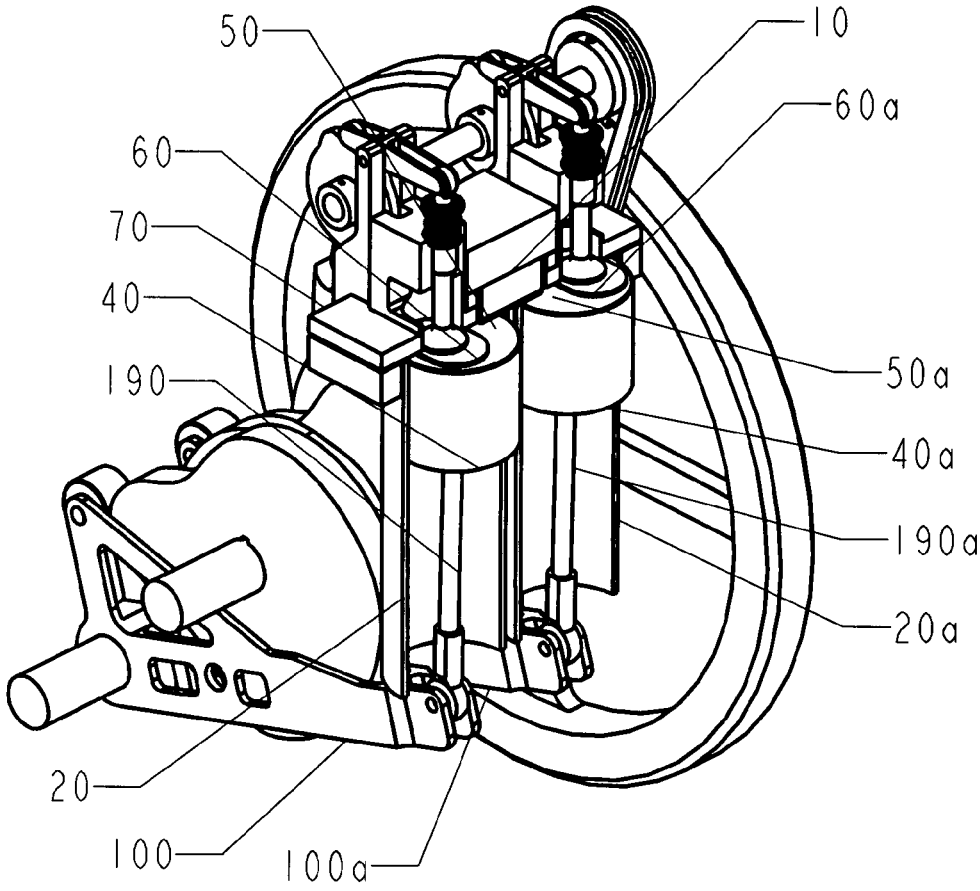
FIG. 9 is a perspective partially cut-away view illustrating an engine according to the present disclosure, as it appears at timing diagram point (a) shown in FIG. 2.

At the start of the cycle angle (a) (FIG. 2), the volume and mass of air in the engine are at a minimum. The engine at cycle angle (a) is shown in FIG. 9. The previous exhaust process has expelled virtually all of the working fluid from working chambers 50 and 50*a*, with the only remaining working fluid occupying the dead volume inside heat exchanger 10 and the unswept volume in working chambers 50 and 50*a*. At this point, both poppet valves 60 and 60*a* open, allowing fresh working fluid to enter the working chambers 50 and 50*a* as both pistons 40 and 40*a* move downward to pull in working fluid.

Figure 10:
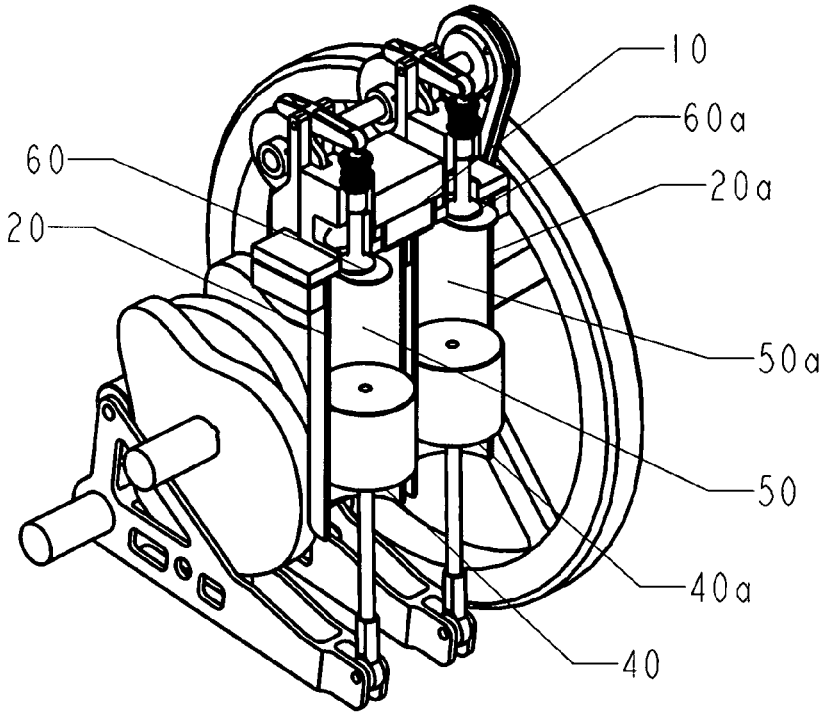
FIG. 10 is a partially cut-away view illustrating the engine of FIG. 9 at timing diagram point (b) shown in FIG. 2.

At cycle angle (b) (FIG. 2), thermodynamic state A (FIG. 1), when the intake process is complete, the total volume in the working chambers 50 and 50*a* is greater than the ideal thermodynamic $V_A$. With reference to FIG. 10 showing the completed intake process, a long intake stroke is used to account for less than 100% volumetric efficiency of the intake process and ensure a full mass quantity of air is brought in.

Figure 11:
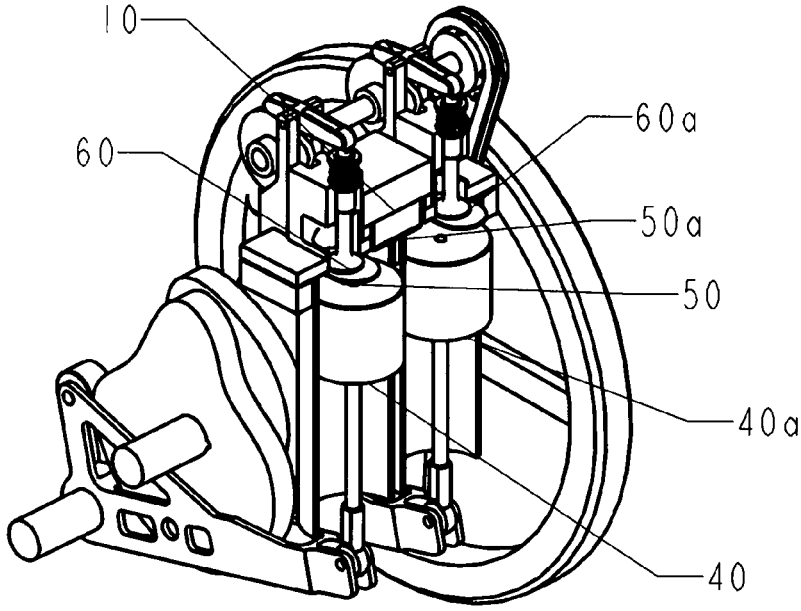
FIG. 11 is a partially cut-away view illustrating the engine of FIG. 9 at timing diagram point (c) shown in FIG. 2.

With reference to FIG. 11, both pistons 40 and 40*a* move to compress the working fluid to state B at cycle angle (c) (FIG. 2). The compression ratio $C_r$ is defined such that the nominal air temperature at this point equals the isothermal temperature $T_B$ (calculated as isentropic compression). Some reasonable volume of air should remain in working chambers 50 and 50*a* after compression to state C (FIG. 1) in order to allow a reasonable fluid velocity when forced through the heat exchanger.

The process from cycle angles (c) to (e) (FIG. 2) corresponds to the isothermal expansion process 2 (FIG. 1). Once cycle angle (c) is reached, the second piston 40*a* draws away from the heat exchanger 10 while first piston 40 continues upward toward the heat exchanger 10. The speed of second piston 40*a* is greater than that of first piston 40 such that the total working volume in the engine is increasing.

Figure 12:
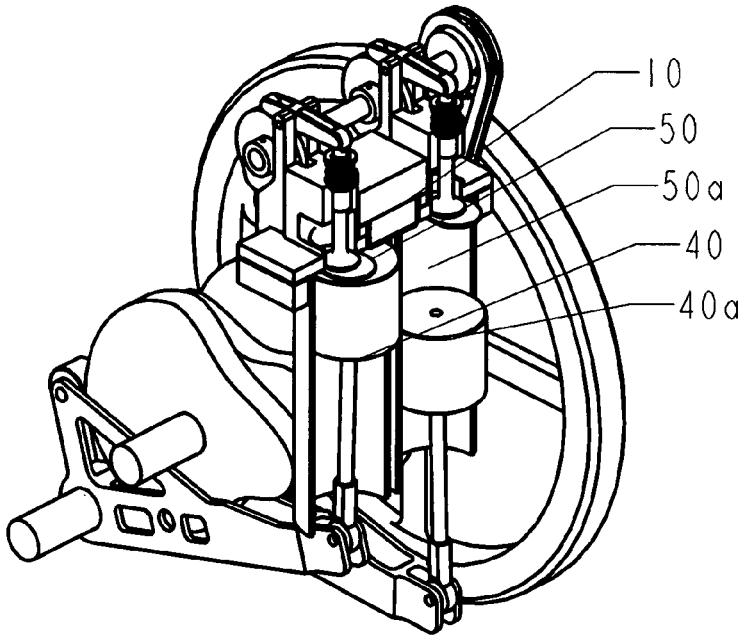
FIG. 12 is a partially cut-away view illustrating the engine of FIG. 9 at timing diagram point (d) shown in FIG. 2.

With reference to FIG. 12, at cycle angle (d) (FIG. 2), all of the working fluid in first working chamber 50 has been shuttled through the heat exchanger 10 into second working chamber 50*a*. This cycle angle (d) (FIG. 2) represents the mid-point of the isothermal expansion process 2 (FIG. 1).

The action of shuttling the working fluid between working chambers 50 and 50*a* through heat exchanger 10 serves to add heat energy to the working fluid while it is expanding. Energy is being removed from the engine by expansion at the same rate it is being added as heat, causing net power output to be positive and net change in enthalpy and temperature of the working fluid to be zero.

Once the first piston 40 has forced all of the working fluid out of working chamber 50 and through the heat exchanger, the second piston 40*a* piston effectively stops moving while the first piston 40 begins moving downward, drawing working fluid once again through the heat exchanger 10 and into working chamber 50, expanding the total working volume further.

Figure 13:
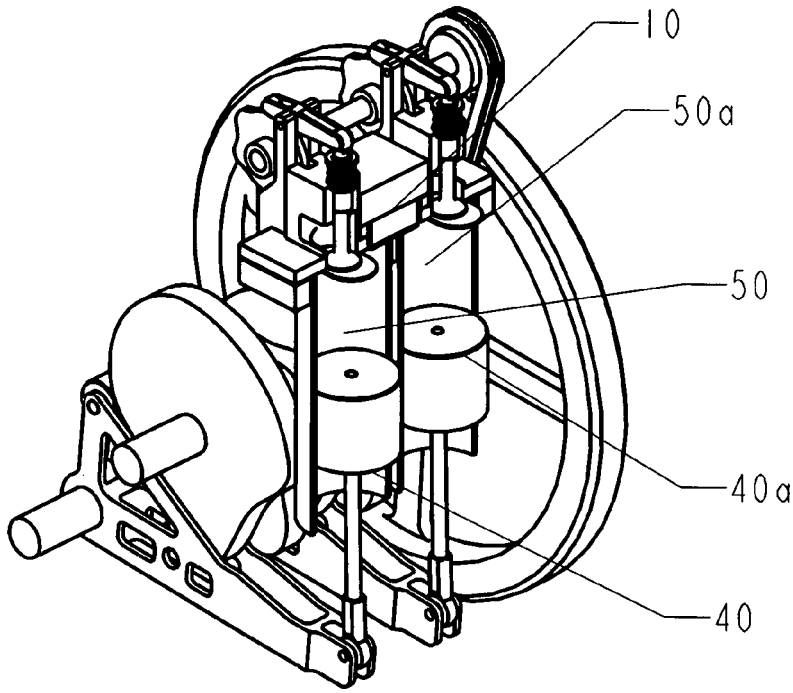
FIG. 13 is a partially cut-away view illustrating the engine of FIG. 9 at timing diagram point (e) shown in FIG. 2.

At cycle angle (e) (FIG. 2) as seen in FIG. 13, i.e., thermodynamic state C (FIG. 1), the isothermal expansion is complete. First piston 40 and second piston 40*a* have reached an equal distance from heat exchanger 10 and working chambers 50 and 50*a* comprise equal volumes, and total engine volume equals the desired volume at thermodynamic state C (FIG. 1).

All power from the heat source during this cycle has been achieved. The heat input has been converted to mechanical energy such that the temperature has been maintained constant at $T_B$. The piston locations at cycle angle (e) (FIG. 2) are defined by the isothermal expansion ratio $E_r$ (defining the final volume) and by the necessity that pistons 40 and 40*a* be equidistant from heat exchanger 10 to minimize any working fluid flow through the heat exchanger 10 during the intake and exhaust processes.

At the end of the isothermal process 2 (FIG. 1), there is still a small amount of pressure energy remaining in the working fluid. The adiabatic expansion process 3 (FIG. 1) is intended to capture as much of this available energy as possible.

Figure 14:
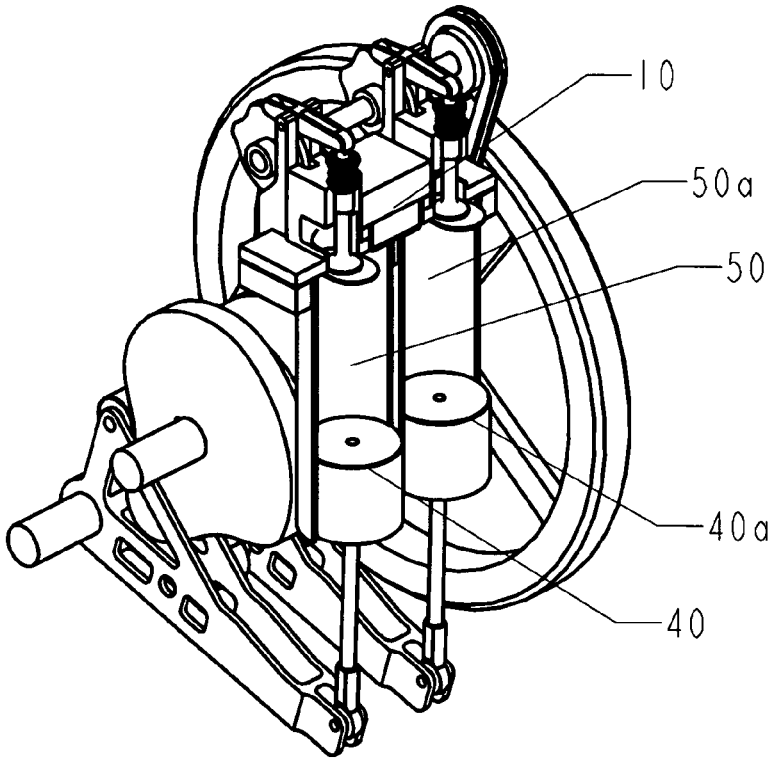
FIG. 14 is a partially cut-away view illustrating the engine of FIG. 9 at timing diagram point (f) shown in FIG. 2.

As the pistons 40 and 40*a* continue to move away from the heat exchanger 10, the working fluid expands adiabatically while energy is recovered. With reference to FIG. 14, the volume expands until cycle angle (f), thermodynamic state D (FIG. 1), when pressure inside the working chambers 50 and 50*a* is equal to ambient pressure. The total engine volume at state D is greater than the volume at state A (FIG. 1).

After adiabatic expansion process 3 (FIG. 1), both poppet valves 60 and 60*a* move to open. Pistons 40 and 40*a* move upward, forcing the working fluid out of working chambers 50 and 50*a* during the exhaust process.

Figure 15:
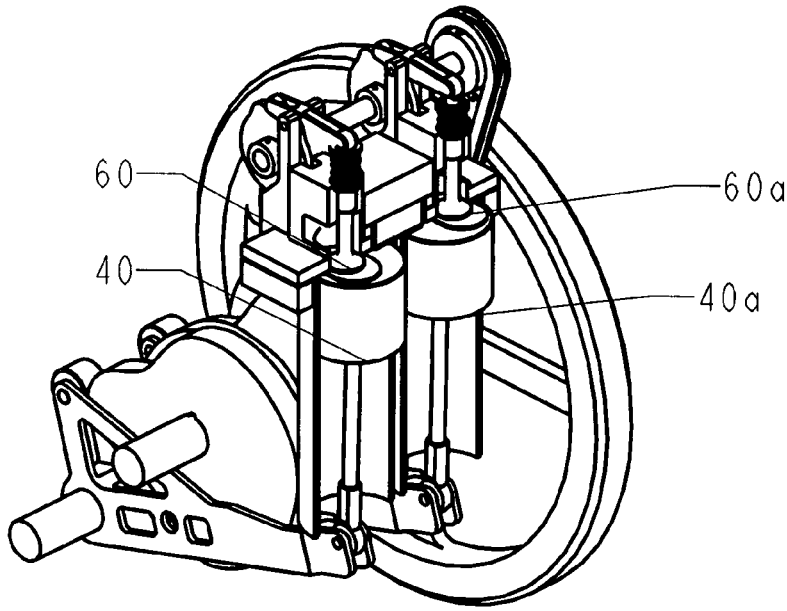
FIG. 15 is a partially cut-away view illustrating the engine of FIG. 9 at timing diagram point (g) shown in FIG. 2.

As the pistons 40 and 40*a* reach top dead center, both poppet valves 60 and 60*a* remain open as much as allowable for maximum flow. With reference to FIG. 15, at cycle angle (g) (FIG. 2), an engine cycle is complete and a new cycle begins. Note that the positions of the pistons 40 and 40*a* in FIG. 15 are the same as in FIG. 9.

Vibration caused by the eccentric timing of the pistons would be excessive in higher power engines using only two cylinders. Therefore, it is contemplated that a production engine would be made with multiple piston pairs axially opposed and out of phase to cancel vibration. For example, two piston pairs would be disposed axially and opposite one another and with their respective timing phased so to minimize vibration and also to maintain a more steady power generation over one revolution of the engine.

The foregoing is a non-limiting example of the way isothermal timing may be implemented, and does not constrain the mode by which thermodynamic cycle of general embodiments may be implemented. Thus, the present disclosure is merely one means of implementing the method of the invention generally, and the isothermal timing method specifically. In alternative embodiments, multiple pistons, various actuating schemes such as standard automotive crankarms, electromagnetic or hydraulic actuation may be employed.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all applications, patents, and publications cited above are hereby incorporated by reference.

I claim:

1. A method for operating a thermal engine to convert thermal energy to mechanical energy, comprising the steps of:

providing a unit mass of working fluid at an ambient temperature and an ambient pressure;

isentropically compressing the unit mass of working fluid to a higher temperature and a higher pressure;

isothermally expanding the unit mass to a first subsequent volume;

uniformly adding heat energy to the unit mass of working fluid by moving the unit mass past a heat exchanger while maintaining a constant Reynolds number through the heat exchanger;

isentropically expanding the unit mass of working fluid to a second subsequent volume;

driving with the isothermally expanding working fluid a first piston and a second piston in respective cylinders, thereby turning a shaft through at least one angular rotation;

timing the driving of the first piston and the second piston such that a substantially equal amount of working fluid expansion energy is used for each angular rotation of the shaft; and exhausting at least a portion of the unit mass of working fluid;

wherein the positions of the pistons in the cylinders during isothermal expansion are a function of a shaft rotation angle.

2. The method of claim 1 wherein the step of timing the driving of the pistons further comprises determining a required total engine volume as a function the shaft rotation angle.

3. The method of claim 2 wherein the step of determining a required total engine volume comprises determining a required total engine volume V as a function of a shaft rotation angle θ, using the formulae $$dE(\theta)/d\theta = P \cdot dV = \text{Constant and}$$

$$V = V_i e^{K/\bar{R}T(\theta-\theta_1)}$$

wherein P is pressure and E is the energy extracted from the expanding working fluid, engine volume V is a function of the engine shaft rotation angle θ, K is an angular power increment, $\theta_1$ is a shaft angle at the beginning of isothermal expansion, and $V_i$ is an engine volume at the start of isothermal expansion.

4. The method of claim 3 further comprising determining the position of the first piston as a function of the shaft rotation angle θ during isothermal expansion.

5. The method of claim 4 wherein the step of determining the position of the first piston comprises:

choosing a constant Reynolds number value Re;

defining with the first piston and its corresponding cylinder a first working chamber; and calculating a first working chamber volume $V_1$ using the formulae $$U_m = \frac{\mu Re}{\rho L}$$

and $$V = V_i e^{K/\bar{R}T(\theta-\theta_1)}$$

wherein $U_m$ is mean flow velocity, μ is the thermal diffusivity of the working fluid, ρ is the density of the working fluid, and L is the characteristic length of the heat exchanger.

6. The method of claim 5 further comprising:

defining with the second piston and is corresponding cylinder a second working chamber; and determining the position of the second piston using the formula $$V = V_1 + V_2 + \text{Dead_Volume}$$

wherein $V_1$ is the first working chamber volume, $V_2$ is a second working chamber volume, and Dead_Volume is the un-swept volume in the engine, including the heat exchanger volume.

7. A method for timing the operation of a thermal engine exploiting a thermodynamic cycle including an isothermal expansion step, comprising:

isothermally expanding a working fluid against a moveable piston to turn a loaded shaft through at least one angular rotation;

determining a required total engine volume V as a function of a shaft angle θ, using the formulae $$dE(\theta)/d\theta = P \cdot dV = \text{Constant and}$$

$$V = V_i e^{K/\bar{R}T(\theta-\theta_1)}$$

wherein P is pressure and E is the energy extracted from the expanding working fluid, engine volume V is a function of the engine shaft angle θ, K is an angular power increment, $\theta_1$ is an isothermal begin angle, and $V_i$ is the engine volume at the start of isothermal expansion; and determining a piston position as a function of shaft angle during isothermal expansion.

8. The method of claim 7 further comprising inputting substantially uniformly heat energy into the expanding working fluid by constraining fluid flow through the heat exchanger such that Reynolds number is constant.

9. A thermal engine for converting thermal energy to mechanical energy, comprising:

means for drawing a unit mass of working fluid into a compression chamber at an ambient temperature and an ambient pressure, comprising:

a compression piston slidably movable within a compression cylinder; and a transfer piston slidably moveable within a transfer cylinder, said transfer cylinder in fluid communication with said compression cylinder;

means for iseniropically compressing said unit mass of working fluid to a higher temperature and a higher pressure, comprising;

said compression piston slidably movable within said compression cylinder; and said transfer piston slidably moveable within a transfer cylinder in fluid communication with said compression cylinder;

a heat exchanger, external to the working fluid, for uniformly adding heat energy to said unit mass while isothermally expanding the unit mass of working fluid to a first subsequent volume, wherein said compression piston is slidably movable in said compression cylinder to push at least a portion of said unit mass past said heat exchanger while maintaining a constant Reynolds number through said heat exchanger;

a drive shaft in operative connection with said pistons, whereby isothermally expanding working fluid causes said shaft to turn through at least one angular rotation;

means for isentropically expanding said unit mass to a second subsequent volume, comprising said compression piston moving within said compression cylinder; and a valve for exhausting working fluid from the engine;

wherein positions of said pistons in said cylinders during isothermal expansion are a function of a rotation angle of said drive shaft.

10. The engine of claim 9 wherein, during isothermal expansion, timing of the sliding movements of said pistons causes a unit of angular rotation of said drive shaft to capture of a constant unit amount of working fluid expansion energy.

* * * * *